US005203928A

United States Patent [19]

Inokuti et al.

[11] Patent Number: 5,203,928

[45] Date of Patent: Apr. 20, 1993

[54] METHOD OF PRODUCING LOW IRON LOSS GRAIN ORIENTED SILICON STEEL THIN SHEETS HAVING EXCELLENT SURFACE PROPERTIES

[75] Inventors: Yukio Inokuti; Yoh Ito, both of Chiba, Japan

[73] Assignee: Kawasaki Steel Corporation, Japan

[21] Appl. No.: 774,384

[22] Filed: Oct. 11, 1991

Related U.S. Application Data

[63] Continuation of Ser. No. 540,293, Jun. 19, 1990, abandoned, which is a continuation of Ser. No. 117,154, filed as PCT/JP86/00138 on Mar. 25, 1986, abandoned.

[51] Int. Cl.[5] ..... H01F 1/18

[52] U.S. Cl. ..... 148/111; 148/112; 148/113

[58] Field of Search ..... 148/111, 112, 113, 12 A

[56] References Cited

U.S. PATENT DOCUMENTS

| | | | |
|---|---|---|---|
| 3,823,042 | 7/1974 | Bölling et al. | 148/112 |
| 4,469,533 | 9/1984 | Inokuti et al. | 148/111 |
| 4,713,123 | 12/1987 | Inokuti et al. | 148/113 |
| 4,806,176 | 2/1989 | Harase et al. | 148/112 |
| 4,824,493 | 4/1989 | Yoshitomi et al. | 148/112 |
| 4,948,433 | 8/1990 | Nakashima et al. | 148/113 |
| 4,975,127 | 12/1990 | Kurosawa et al. | 148/111 |

FOREIGN PATENT DOCUMENTS

| | | |
|---|---|---|
| 0108575 | 5/1984 | European Pat. Off. . |
| 2268868 | 11/1975 | France . |
| 2472614 | 7/1981 | France . |
| 54-13866 | 6/1979 | Japan . |
| 57-2252 | 1/1982 | Japan . |
| 57-18810 | 4/1982 | Japan . |
| 57-53419 | 11/1982 | Japan . |
| 58-5968 | 2/1983 | Japan . |
| 58-26405 | 6/1983 | Japan . |
| 58-26406 | 6/1983 | Japan . |
| 58-26407 | 6/1983 | Japan . |
| 58-36051 | 8/1983 | Japan . |
| 59-35625 | 2/1984 | Japan . |
| 59-85820 | 5/1984 | Japan . |
| 59-100221 | 6/1984 | Japan . |
| 59-100222 | 6/1984 | Japan . |
| 59-126722 | 7/1984 | Japan . |
| 60-39124 | 2/1985 | Japan . |
| 60-89521 | 5/1985 | Japan . |
| 60-89545 | 5/1985 | Japan . |
| 60-92479 | 5/1985 | Japan . |
| 60-96720 | 5/1985 | Japan . |
| 60-103120 | 6/1985 | Japan . |
| 60-103132 | 6/1985 | Japan . |
| 60-103182 | 6/1985 | Japan . |
| 60-255926 | 12/1985 | Japan . |
| 34118 | 2/1986 | Japan . |
| 1266957 | 3/1972 | United Kingdom . |

*Primary Examiner*—George Wyszomierski
*Attorney, Agent, or Firm*—Austin R. Miller

[57] ABSTRACT

It is a technical subject to advantageously avoid the degradation of surface properties in a low iron loss grain oriented silicon steel sheet as a material for transformers, particularly if it is intended to thin the gauge to 0.1~0.25 mm. A low iron loss grain oriented silicon steel thin sheet can stably be produced without causing the degradation of performances through strain relief annealing by considering a chemical composition in steel, optimizing the rolling conditions, particularly cold rolling conditions, and further forming heterogeneous microareas onto the steel sheet surface.

9 Claims, 3 Drawing Sheets

◉ $W_{17/50}$: Less than 0.85 W/kg, $B_{10}$: Not less than 1.92 T

◑ $W_{17/50}$: Not less than 0.85 but Less than 0.90 W/kg, $B_{10}$: Not less than 1.90 but Less than 1.92 T × $W_{17/50}$: Not less than 0.90 but Less than 0.95 W/kg, $B_{10}$: Not less than 1.89 but Less than 1.90 T ※ $W_{17/50}$: Not less than 0.95 W/kg, $B_{10}$: Less than 1.89 T

METHOD OF PRODUCING LOW IRON LOSS GRAIN ORIENTED SILICON STEEL THIN SHEETS HAVING EXCELLENT SURFACE PROPERTIES

This application is a continuation of application Ser. No. 07/540,293 filed Jun. 19, 1990, which is a continuation of application Ser. No. 07/117,154 filed as PCT/JP86/00138 on Mar. 25, 1986, all abandoned.

TECHNICAL FIELD

In connection with the improvement of surface properties in low iron loss grain oriented silicon steel sheets, particularly thin sheets as well as the improvement of magnetic flux density by the control of secondary recrystallized grain, the technical content disclosed throughout the specification proposes results on research and development capable of producing the above silicon steel sheets in a stable manner.

BACKGROUND ART

The grain oriented silicon steel sheets can be utilized as cores for transformers and other electrical machinery and equipment, and are required to have a high magnetic flux density (represented by their $B_{10}$ value) and a low iron loss (represented by their $W_{178/50}$ value).

Up to the present, there have been many attempts for achieving the above requirement, and grain oriented silicon steel sheets having a low iron loss with a magnetic flux density, a $B_{10}$ value of not less than 1.89T and an iron loss, and a $W_{17/50}$ value of not more than 1.05 W/kg are manufactured today.

However, the production of a grain oriented silicon steel sheet having a lower iron loss has become an urgent problem bordering on the energy crisis. In this connection, a system of granting a bonus on super-low iron loss silicon steel sheets (Loss evaluation system) is widely spread in Europe and America.

Recently, the following methods are proposed for producing grain oriented silicon steel sheets having a considerably reduced iron loss value.

That is, as disclosed in each of Japanese Patent Application Publication No. 57-2,252, Japanese. Patent Application Publication No. 58-53,419, Japanese Patent Application Publication No. 58-5,968, Japanese Patent Application Publication No. 58-26,405, Japanese Patent Application Publication No. 58-26,406, Japanese Patent Application Publication No. 58-26,407, and Japanese Patent Application Publication No. 58 36,051, an artificial grain boundary is introduced into the surface of the grain oriented silicon steel sheet by utilizing an AlN precipitation phase as an inhibitor for inhibiting the growth of crystal grains in an unsuitable direction at finish annealing and irradiating a laser beam onto the steel sheet surface at an interval of several mm in a direction substantially perpendicular to the rolling direction to thereby reduce the iron loss through the artificial grain boundary.

In such a method of introducing an artificial grain boundary, however, regions of high transformation density are locally formed, so that there is a problem that the resulting products are stably used only at a low temperature below about 350° C.

In the production of the grain oriented silicon steel sheet utilizing the AlN precipitation phase as mentioned above, it is necessary to conduct the heating of the slab before hot rolling at a temperature higher than that of ordinary steel for the dissociation and solution of MnS coexistent with AlN as an inhibitor, but when the slab heating is carried out at such a high temperature, hot tearing is caused at the slab heating or hot rolling stage to cause the occurrence of surface defects in the product, and particularly the surface properties of the product are considerably degraded when the content of Si obstructing the hot workability exceeds 3.0%.

In this point, as disclosed in Japanese Patent Laid open No. 59-85,820, the inventors have noticed that when utilizing the AlN precipitation phase, a silicon steel material having a high Si content of Si: 3.1~4.5% is essentially a material suitable for obtaining a high magnetic flux density, low iron loss product, and have found that the surface properties can be made good even at the high Si content by enriching the Mo content in the surface layer of the steel material before the hot rolling as a means for solving the problem of degradation of surface properties. According to this means, the surface properties of the product are largely improved as compared with the former case, but if it is particularly intended to thin the gauge of the product to 0.23~0.17 mm for obtaining low iron loss, there remains a large problem that the improvement effect on the surface properties is small.

Aside from this, the utilization of an AlN precipitation phase is naturally dependent on a strong one-stage cold rolling process, so that if it is intended to manufacture a thinned product, the secondary recrystallized grains become very unstable, and it is difficult to grow the secondary recrystallized grains highly aligned in Goss orientation.

Lately, Japanese Patent laid open No. 59-126,722 discloses that in order to stably manufacture thinned products by utilizing an AlN precipitation phase at high Si content, a two-stage cold rolling process largely different from the conventional strong one-stage cold rolling process may particularly be applied to a hot rolled material containing small amounts of Cu and Sn in addition to AlN.

This is effective for stably reducing the iron loss of the thinned product, but has yet many problems is that it is difficult to obtain products having excellent surface properties because high-temperature heating of the slab is usually required with increased Si and that the cost of the product becomes considerably higher because small amounts of Sn and Cu are added for stabilizing secondary recrystallized grains.

As a method of reducing the iron loss of the grain oriented silicon steel sheet, there are fundamentally considered the following methods;

1. the increasing of Si content in silicon steel;
2. the thinning of product gauge;
3. increasing the purity of the steel sheet;
4. the growing of secondary recrystallized fine grains without lowering the degree of alignment of the secondary recrystallized grain in Goss orientation in the product.

At first, it has been attempted to increase the Si content to a value higher than the usual value of 3.0% as regards the method (1), or to thin the product gauge from the usual values of 0.35, 0.30 mm to 0.23, 0.20 mm as regards the method (2). In any case, however, problems are encountered in that the secondary recrystallized texture becomes non-uniform and the Goss orientation alignment lowers.

In addition, when the Si content is increased from the usual value according to the method (1), hot brittleness becomes conspicuous, and hot tearing is caused in slab heating or hot rolling to considerably degrade the surface properties of the product as previously mentioned.

On the other hand, the development of the improvement of steel sheet purity (3) or orientation (4) is considered to be extreme at the present. For example, the Goss orientation of secondary recrystallized grains in the existing products is aligned within 3°~4° on average with respect to the rolling direction, so that it is very difficult in metallurgy to make the crystal grain small under such a highly aligned state.

Considering the recent trend of the aforementioned conventional techniques and the backgrounds of the above situations, it is an object of the invention to provide a method of stably and advantageously producing grain oriented silicon steel thin sheets having very excellent surface properties, a considerably small iron loss and a high magnetic flux density on an industrial scale.

DISCLOSURE OF INVENTION

The above object is achieved as follows.

According to a primary embodiment of this invention there is provided a method of producing a low iron loss grain oriented silicon steel thin sheet having excellent surface properties, which comprises subjecting a steel slab containing Si: 3.1~4.5 wt %,
Mo: 0.003~0.1 wt %,
acid soluble Al: 0.005~0.06 wt %, and
at least one of S and Se: 0.005~0.1 wt % in total to hot rolling to form a hot rolled steel sheet;

subjecting the hot rolled steel sheet to primary cold rolling at a reduction of 10~60% and an intermediate annealing and a secondary cold rolling at a reduction of 75~90% to obtain a cold rolled thin sheet having a final gauge of 0.1~0.25 mm; subjecting the cold rolled thin sheet to decarburization and primary recrystallization annealing in a wet hydrogen atmosphere; and subjecting the thin sheet to high-temperature finish annealing.

According to a second embodiment of the invention there is provided a method of producing a low iron loss grain oriented silicon steel thin sheet having excellent surface properties, which comprises subjecting a steel slab containing Si: 3.1~4.5 wt %,
Mo: 0.003~0.1 wt %,
Sb: 0.005~0.2 wt %,
acid soluble Al: 0.005~0.06 wt %, and
at least one of S and Se: 0.005~0.1 wt % in total to hot rolling to form a hot rolled steel sheet;

subjecting the hot rolled steel sheet to primary cold rolling at a reduction of 10–60% and an intermediate annealing and a secondary cold rolling at a reduction of 75~90% to obtain a cold rolled thin sheet having a final gauge of 0.1~0.25 mm;

subjecting the cold rolled thin sheet to decarburization and primary recrystallization annealing in a wet hydrogen atmosphere; and subjecting the thin sheet to a high-temperature finish annealing.

According to a third embodiment of the invention there is provided a method of producing a low iron loss, high magnetic flux density grain oriented silicon steel thin sheet having excellent surface properties, which comprises subjecting a steel slab containing Si: 3.1~4.5 wt %,
Mo: 0.003~0.1 wt %,
acid soluble Al: 0.005~0.06 wt %, and
at least one of S and Se: 0.005~0.1 wt % in total to hot rolling to form a hot rolled steel sheet;

subjecting the hot rolled steel sheet to primary cold rolling at a reduction of 10~60% and an intermediate annealing and a secondary cold rolling at a reduction of 75–90% to obtain a cold rolled thin sheet having a final gauge of 0.1–0.25 mm; subjecting the cold rolled thin sheet to decarburization and primary recrystallization annealing in a wet hydrogen atmosphere, during which it is previously subjected to a treatment for the formation of heterogeneous microareas onto the surface of the thin sheet after the subsequent high-temperature finish annealing; and subjecting the thin sheet to high-temperature finish annealing.

According to a fourth embodiment of the invention there is provided a method of producing a low iron loss, high magnetic flux density grain oriented silicon steel thin sheet having excellent surface properties, which comprises subjecting a steel slab containing Si: 3.1~4.5 wt %,
Mo: 0.003~0.1 wt %,
Sb: 0.005~0.2 wt %,
acid soluble Al: 0.005~0.06 wt %, and
at least one of S and Se: 0.005~0.1 wt % in total to hot rolling to form hot rolled steel sheet; subjecting the hot rolled steel sheet to primary cold rolling at a reduction of 10~60% and an intermediate annealing and a secondary cold rolling at a reduction of 75~90% to obtain a cold rolled thin sheet having a final gauge of 0.1~0.25 mm; subjecting the cold rolled thin sheet to decarburization and primary recrystallization annealing in a wet hydrogen atmosphere, during which it is previously subjected to a treatment for the formation of heterogeneous microareas onto the surface of the thin sheet after the subsequent high-temperature finish annealing; and subjecting the thin sheet to high-temperature finish annealing.

According to a fifth embodiment of the invention there is provided a method of producing a low iron low grain oriented silicon steel thin sheet having excellent surface properties, which comprises subjecting a steel slab containing Si: 3.1~4.5 wt %,
Mo: 0.003~0.1 wt %,
acid soluble Al: 0.005~0.06 wt %, and
at least one of S and Se: 0.005~0.1 wt % in total to a hot rolling to form a hot rolled steel sheet; subjecting the hot rolled steel sheet to primary cold rolling at a reduction of 10~60% and intermediate annealing and secondary cold rolling at a reduction of 75~90% to obtain a cold rolled thin sheet having a final gauge of 0.1~0.25 mm; subjecting the cold rolled thin sheet to decarburization and primary recrystallization annealing in a wet hydrogen atmosphere; subjecting the thin sheet to high-temperature finish annealing; and forming heterogeneous microareas onto the surface of the thin sheet.

According to a sixth embodiment there is provided a method of producing a low iron loss grain oriented silicon steel thin sheet having excellent surface properties, which comprises subjecting a steel slab containing Si: 3.1~4.5 wt %,
Mo: 0.003~0.1 wt %,
Sb: 0.005~0.2 wt %,
acid soluble Al: 0.005~0.06 wt %, and
at least one of S and Se: 0.005~0.1 wt % in total to hot rolling to form hot rolled steel sheet; subjecting the hot rolled steel sheet to primary cold rolling at a reduction of 10~60% and an intermediate annealing and secondary cold rolling at a reduction of 75~90% to obtain a cold rolled thin sheet having a final gauge of 0.1~0.25 mm; subjecting the cold rolled thin sheet to decarburization and primary recrystallization annealing in a wet hydrogen atmosphere; subjecting the thin sheet to high-temperature finish annealing; and forming heterogeneous microareas onto the surface of the thin sheet.

Moreover, it is preferable that the intermediate annealing in each of the above, embodiments is carried out by heating or cooling at a rate of 5° C. per second over a range of 500°~900° C. at the temperature rising or temperature dropping stage.

The inventors have found that when a grain oriented silicon steel thin sheet is produced by utilizing an AlN precipitation phase at a high silicon content of 3.1~4.5 wt %, products having excellent surface properties are obtained by adding a small amount of Mo to the steel material and also the production of grain oriented silicon steel sheets having a low iron loss is made possible with very stable steps by the adoption of a two-stage cold rolling process including an intermediate annealing with rapid heating rapid cooling, and as a result each of the above inventions has been accomplished.

BEST MODE OF CARRYING OUT THE INVENTION

At first, the invention will be described in detail with respect to experimental examples resulting in the success of the first invention.

Each of a steel ingots (test steel I) containing C: 0.048 wt %, Si: 3.40 wt %, Mo: 0.025 wt %, acid soluble Al: 0.026 wt % and S: 0.025 wt % and a steel ingot (comparative steel I) containing C: 0.053 wt %, Si: 3.42 wt %, acid soluble Al: 0.027 wt %, S: 0.024 wt %, Sn: 0.11 wt % and Cu: 0.09 wt % was heated at 1,420° C. for 4 hours and was thereafter hot rolled to form a hot rolled steel sheet of 2.2 mm in thickness.

Then, the hot rolled steel sheet was subjected to a primary cold rolling at a reduction of not more than 70% and further to an intermediate annealing at 1,050° C. for 3 minutes. In the intermediate annealing, the temperature rise from 500° C. to 900° C. was carried out by rapid heating treatment at 10° C./s, and the temperature decrease from 900° C. to 500° C. was carried out by rapid cooling treatment at 15° C./s.

Thereafter, the steel sheet was subjected to a secondary cold rolling at a reduction of 70%~91% to obtain a cold rolled steel sheet having a final gauge of 0.20 mm, which was then subjected to decarburization and primary recrystallization annealing at 850° C. in a wet hydrogen atmosphere.

Then, an annealing separator mainly composed of MgO was applied to the surface of the steel sheet, which was subjected to a secondary recrystallization annealing by raising its temperature between 850° C.~1,100° C. at 8° C./hr and further to a high-temperature finish annealing or a purification annealing in a dry hydrogen atmosphere at 1,200° C. for 10 hours.

Figure 1:
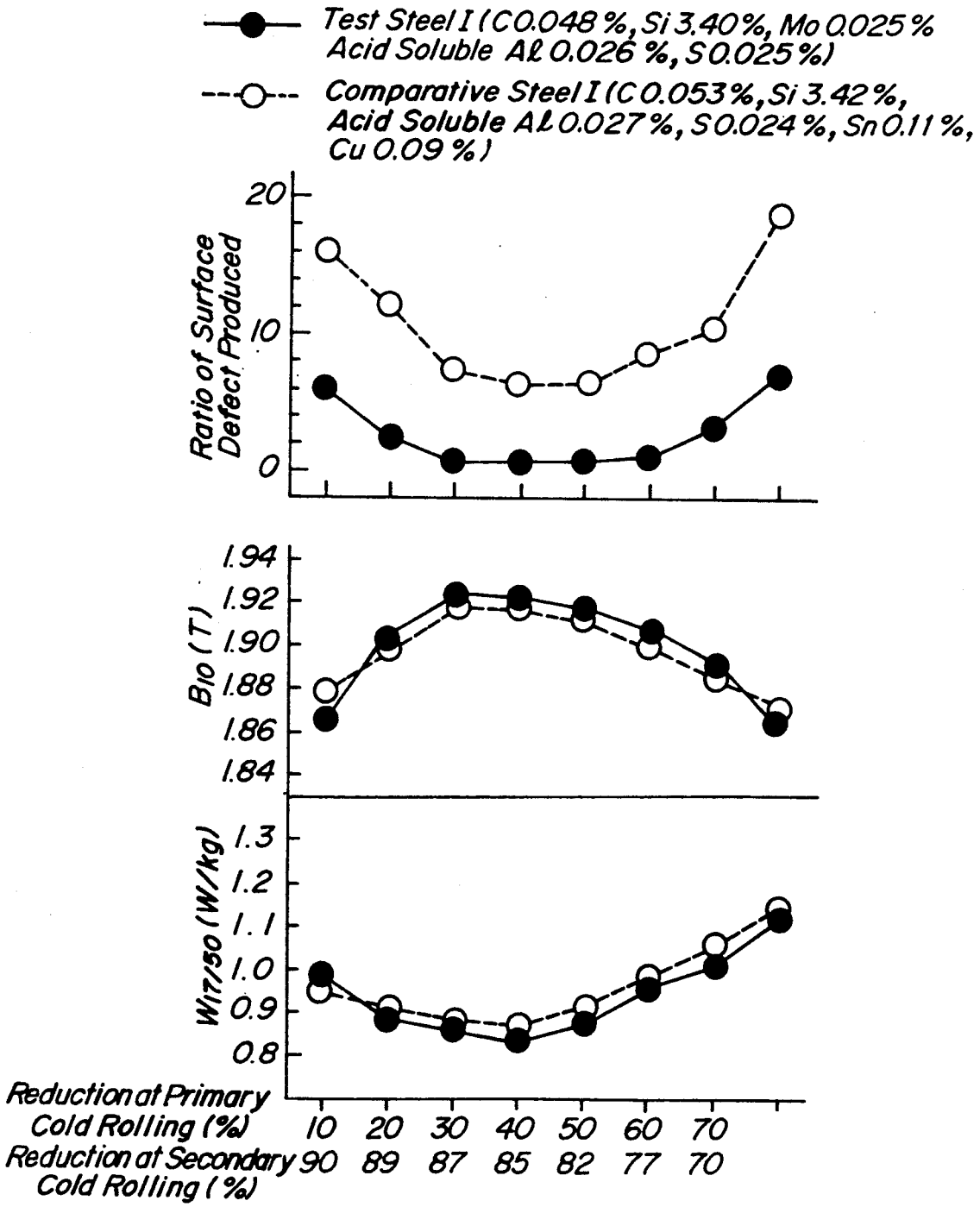
FIG. 1 is a graph showing the relation of magnetic properties of the product to reductions at primary cold rolling and secondary cold rolling and the state of the surface properties.

The magnetic properties of the resulting product and the ratio of surface defects produced (the ratio of surface defect block existing on the steel sheet surface is represented by %) are shown in FIG. 1.

As seen from plots shown by the mark ● in FIG. 1, the product made from the test steel I containing Mo has good magnetic properties when the reduction at primary cold rolling is 10~60% (particularly 20~40%), and the ratio of surface defects produced in the product is not more than 2% (not more than 0.5% when the reduction at primary cold rolling is within a range of 20~25%).

On the contrary, in the product made from the comparative steel I of the conventional composition, the $B_{10}$ value and $W_{17/50}$ value are somewhat poorer than those of the test steel I as magnetic properties as seen from plots shown by mark O in the same figure, and particularly the ratio of surface defects produced in the product is as extremely high as 6~18%.

Then, a steel ingot (test steel II) containing C: 0.049%, Si: 3.45%, Mo: 0.020%, acid soluble Al: 0.028% and S: 0.026% was heated at 1,410° C. for 5 hours to perform the dissociation solution of inhibitor, and was then hot rolled to form a hot rolled steel sheet of 2.2 mm in thickness.

Thereafter, the hot rolled steel sheet was subjected to a primary cold rolling at a reduction of about 40% and further to an intermediate annealing at 1,050° C. for 3 minutes. In the intermediate annealing, each of the temperature increase rates from 500° C. to 900° C. and cooling rates from 900° C. to 500° C. was varied within a range of 1° C.~100° C.

The steel sheet after the intermediate annealing was subjected to a secondary cold rolling at a reduction of about 83% to obtain a cold rolled steel sheet having a final gauge of 0.23 mm, which was then subjected to decarburization and primary recrystallization annealing at 850° C. in a wet hydrogen atmosphere, an application of an annealing separator mainly composed of MgO onto the steel sheet surface, a secondary recrystallization annealing by raising the temperature from 850° C. to 1,100° C. at 10° C./hr, and purification annealing in a dry hydrogen atmosphere at 1,200° C. for 10 hours. The magnetic properties of the resulting product are shown in FIG. 2.

Figure 2:
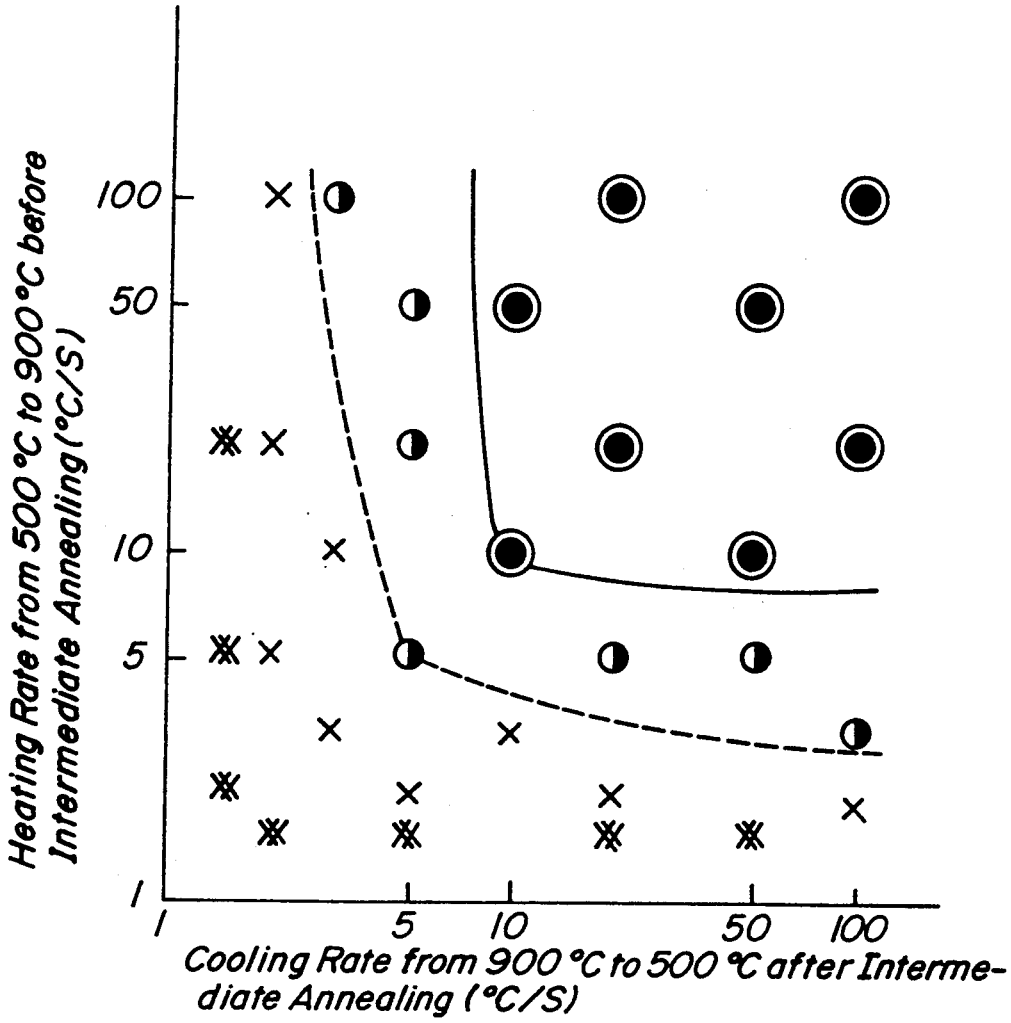
FIG. 2 is a graph showing the relation of temperature rising rate and cooling rate in the intermediate annealing to magnetic properties of the product.

As seen from FIG. 2, products having considerably improved magnetic properties can be obtained when the temperature increase rate from 500° C. to 900° C. at the intermediate annealing and the cooling rate from 900° C. to 500° C. after the intermediate annealing are not less than 5° C./s, particularly not less than 10° C./s.

The reason for the improvement of properties by such rapid heating and rapid cooling treatments in the intermediate annealing is considered to be due to the fact that the secondary recrystallized texture with [110]<001> orientation is preferentially grown as the inventors have previously disclosed in Japanese Patent laid open No. 59-35,625 (previously mentioned). Moreover, the production method of the grain oriented silicon steel thin sheet through the utilization of an AlN precipitation phase by the two-stage cold rolling process in the aforementioned Japanese Patent laid open No. 59-126,722 applies only an AlN micro-precipitation treatment through quenching treatment after normalized annealing in the conventional strong one-stage cold rolling process to the cooling stage of the intermediate annealing after the primary cold rolling, while according to the invention it is newly elucidated that excellent magnetic properties are obtained only by the combination of rapid cooling at the intermediate annealing with rapid heating at the temperature increasing stage of the intermediate annealing and particularly the addition of Mo.

The developmental details of the second invention will be described below.

Each of a continuously cast slab (test steel A) containing C: 0.046 wt %, Si: 3.36 wt %, Mo: 0.026 wt %, Sb: 0.025 wt %, acid soluble Al: 0.024 wt % and Se: 0.020 wt % and a continuously cast slab (comparative steel B) containing C: 0.049%, Si: 3.45%, acid soluble Al: 0.025 wt %, Sb: 0.023 wt % and Se: 0.022 wt % was heated at 1,360° C. for 3 hours to perform the dissociation solution of inhibitor, and then hot rolled to form a hot rolled steel sheet of 2.2 mm in thickness.

Thereafter, the hot rolled steel sheet was subjected to a normalized annealing at 1,050° C. for 2 minutes and quenched.

Then, the steel sheet was subjected to a primary cold rolling at a reduction of about 40% and further to an intermediate annealing at 1,000° C. for 2 minutes. In the intermediate annealing, the temperature increasing from 500° C. to 900° C. was carried out by rapid heating treatment at 10° C./s, and the temperature decrease from 900° C. to 500° C. was carried out by rapid cooling treatment at 12° C./s.

Thereafter, the steel sheet was subjected to a secondary cold rolling at a reduction of 85% to obtain a cold rolled steel sheet having a final gauge of 0.20 mm, which was subjected to decarburization and primary recrystallization annealing at 830° C. in a wet hydrogen atmosphere.

After an annealing separator mainly composed of MgO was applied to the steel sheet surface, the steel sheet was subjected to a secondary recrystallization annealing by raising its temperature from 850° C. at a rate of 10° C./hr, a purification annealing in a dry hydrogen atmosphere at 1,200° C. for 10 hours, a baking treatment with an insulation coating and a strain relief annealing at 800° C. for 3 hours.

The magnetic properties of the resulting product and the ratio of surface defects produced therein (a ratio of surface defect block existing in the steel sheet surface is represented by %) are shown in Table 1.

TABLE 1

| | Steel ingot ingredients (%) | Magnetic properties $B_{10}$ (T) | Magnetic properties $W_{17/50}$ (W/kg) | Surface property Ratio of surface defect block produced (%) |
|---|---|---|---|---|
| (A) | C 0.046%, Si 3.36%, Mo 0.026%, Sb 0.025%, Al 0.024%, Se 0.020% | 1.94 | 0.82 | 1.8 |
| (B) | C 0.049%, Si 3.45%, Al 0.025%, Sb 0.023%, Se 0.022% | 1.93 | 0.85 | 8 |

As seen from the magnetic properties and surface properties of the products shown in Table 1, the magnetic properties of the product made from the test steel A containing Mo therein are good, and that the $B_{10}$ value is 1.94 T and the $W_{17/50}$ value is 0.82 W/kg, and it is noted that the ratio of surface defects produced in the product is 1.8%.

On the contrary, the magnetic properties of the product made from the comparative steel B of the conventional Composition are bad in that $B_{10}$ is 1.93 T and $W_{17/50}$ is 0.85 W/kg as compared with those of the test steel B containing Mo therein, and particularly the ratio of surface defect produced in the product is as extremely high as 8%.

Typically developmental details of the third and fourth inventions will be described below.

Each of a steel ingot (test steel III) containing C: 0.053%, Si: 3.43%, Mo: 0.023%, acid soluble Al: 0.028% and S: 0.027% and a steel ingot (comparative steel II) containing C: 0.056%, Si: 3.46%, acid soluble Al: 0.026%, S: 0.026%, Sn: 0.1% and Cu: 0.1% was heated at 1,430° C. for 3 hours to perform the dissociation solution of inhibitor, and then hot rolled to form a hot rolled steel sheet of 2.2 mm in thickness.

Thereafter, the hot rolled steel sheet was subjected to primary cold rolling at a reduction of not more than 70% and further to intermediate annealing at 1,100° C. for 3 minutes. In the intermediate annealing, the temperature increase from 500° C. to 900° C. was carried out by rapid heating treatment at a heating rate of 13° C./s, and the temperature decrease from 900° C. to 500° C. after the intermediate annealing was carried out by rapid cooling treatment at a cooling rate of 18° C./s.

The steel sheet was then subjected to a secondary cold rolling at a reduction of 70%~91% to obtain a cold rolled steel sheet having a final gauge of 0.20 mm. In this case, a warm rolling at 250° C. was carried out after the cold rolling.

After the surface of the steel sheet was degreased at a temperature of 110° C., an aqueous dilute solution of $MgSO_4$ (0.01 mol/l at 80° C.) was applied at an interval of 5 mm and a width of 0.5 mm in a direction perpendicular to the rolling direction by spraying. For reference, there was also provided a sample of steel sheet surface that was only degreased (reference example).

Each of these samples was subjected to decarburization and primary recrystallization annealing in a wet hydrogen atmosphere, and after an annealing separator mainly composed of MgO was applied to the steel sheet surface, the sample was further subjected to a secondary recrystallization annealing by raising the temperature from 850° C. to 1,100° C. at 10° C./hr and purification annealing in a dry hydrogen atmosphere at 1,200° C. for 10 hours.

Figure 3:
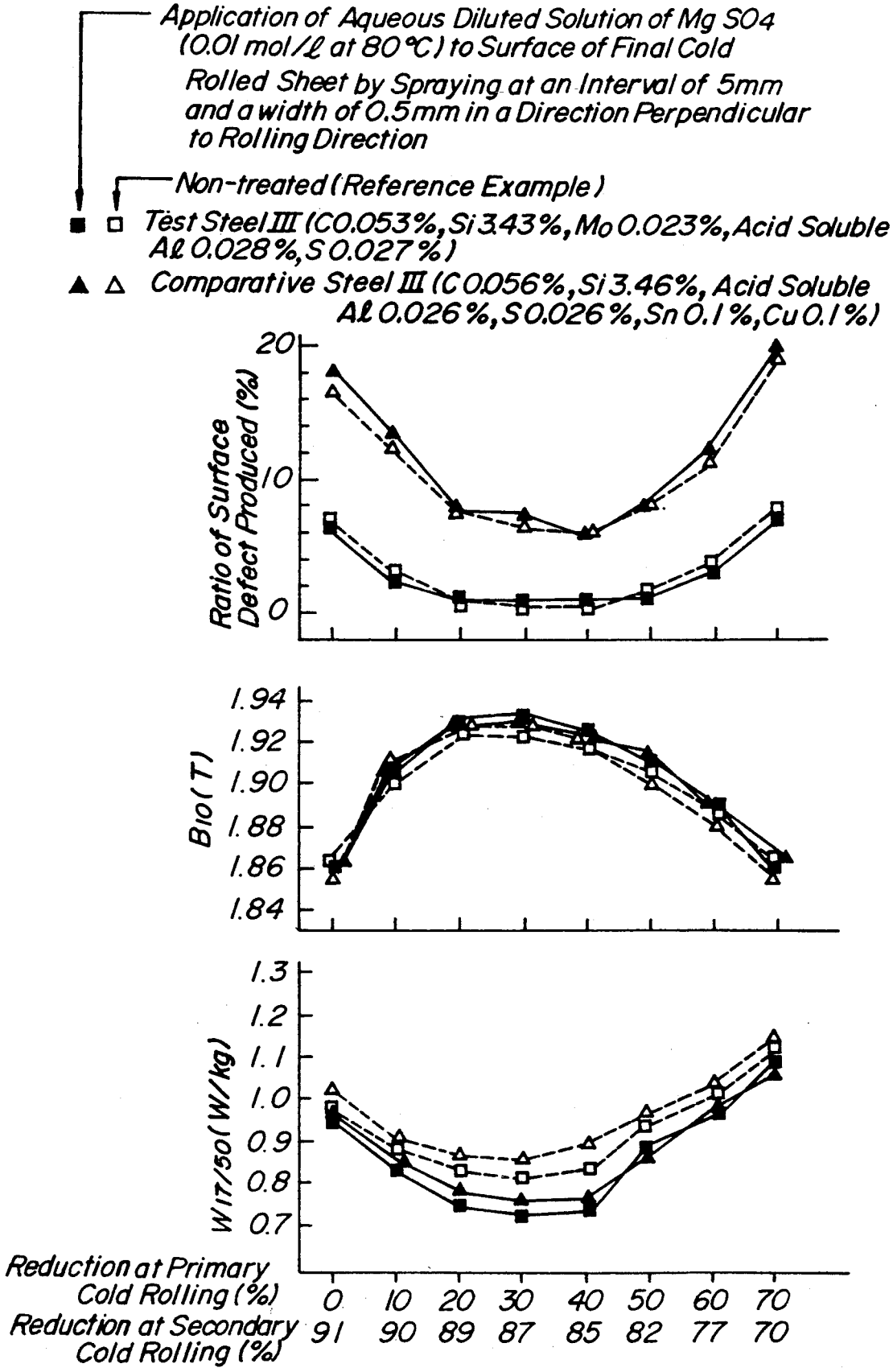
FIG. 3 is a graph showing the relation of magnetic properties of the product to reductions at primary cold rolling and secondary cold rolling and a state of surface properties.

The magnetic properties of the resulting product and the ratio of surface defects produced therein (the ratio of surface defect block existing in the steel sheet surface is represented by %) are shown in FIG. 3.

As seen from FIG. 3, the test steels III containing Mo therein (mark ■, □) had good magnetic properties when the reduction at primary cold rolling was from 10 to 60% (particularly 20~40%), and it is noted that the ratio of surface defect produced in the product was not more than 3% (particularly not more than 1.0% when the reduction at primary cold rolling was within a range of 20~50%). On the contrary, as the properties of the comparative steels II of the conventional composition (mark ▲, △), $B_{10}$ value and $W_{17/50}$ value are somewhat poorer than those of Mo containing steel, and the ratio of surface defect produced in the product was as extremely high as 6~20%.

When the aqueous diluted solution of $MgSO_4$ is applied to the surface of the finally cold rolled steel sheet by spraying at an interval of 5 mm and a width of 0.5 mm in a direction perpendicular to the rolling direction, the magnetic properties are considerably good; the $W_{17/50}$ value is 0.72 W/kg when the reduction at primary cold rolling is 30~40% (reduction at secondary cold rolling, 87~85%) as shown in plots of mark ■ of the test steel III, and the ratio of surface defects produced in the product is as good as not more than 1%.

On the other hand, even in the application treatment for the comparative steel II containing no Mo, the $W_{17/50}$ value of iron loss is as good as 0.75 W/kg when the reduction at primary cold rolling is 30~40% as shown in plots of mark ▲, but the ratio of surface defects produced in the product is as high as 6~7%.

Thus, these experimental examples show that the production of low iron loss grain oriented silicon steel thin sheet having excellent surface properties is achieved by combining the addition of a small amount of Mo to high silicon steel material, the adoption of a two-stage cold rolling process, and the application of a solution or suspension of chemicals exemplified by the aqueous diluted solution of a $MgSO_4$ to the surface of the finally cold rolled steel sheet.

This point has previously been proposed by the inventors as a method of producing a low iron loss grain oriented silicon steel sheet by alternately forming decarburization promotion areas or decarburization delay areas on the steel sheet surface before the decarburization and primary recrystallization annealing in a direction substantially perpendicular to the rolling direction to unhomogeneously grow secondary recrystallized grains and introduce heterogeneous microareas as partially mentioned in Japanese Patent laid open No. 60-39,124, which is used together with the two-stage cold rolling process including the intermediate annealing of rapid heating rapid cooling prior to the application to the finally cold rolled steel sheet surface, whereby the stable growth of secondary recrystallized grains can particularly be achieved. Furthermore, it is effective to apply the method of alternately forming the decarburization promotion areas or decarburization delay areas on the steel sheet surface after the decarburization and primary recrystallization annealing, a part of which has already been disclosed in Japanese Patent laid open No. 60-89,521.

Each of a steel ingot (test steel C) containing C: 0.048%, Si: 3.41%, Mo: 0.024%, acid soluble Al: 0.025%, Sb: 0.025% and S: 0.026% and a steel ingot (test steel C) containing C: 0.052%, Si: 3.38%, acid soluble Al: 0.023% and S: 0.025% was heated at 1,420° C. for 3 hours to perform the dissociation solution of inhibitor and hot rolled to form a hot rolled steel sheet of 2.0 mm in thickness.

Thereafter, the hot rolled steel sheet was subjected to two-stage cold rolling (reduction at primary cold rolling: 50%, reduction at secondary cold rolling: 80%) through an intermediate annealing at 980° C. for 3 minutes to obtain a cold rolled steel sheet having a final gauge of 0.20 mm.

In the intermediate annealing, the temperature increase from 500° C. to 900° C. was carried out by rapid heating treatment at a heating rate of 10° C./s, and the temperature decrease from 900° C. to 500° C. after the intermediate annealing was carried out at a cooling rate of 13° C./s.

After the steel sheet was subjected to decarburization and primary recrystallization annealing in a wet hydrogen atmosphere at 840° C., $Al_2O_3$ powder as a reaction inhibiting substance between annealing separator and $SiO_2$ in subscale of the steel sheet was linearly adhered to the steel sheet surface under conditions that the adhesion amount was 0.5 g/m$^2$, the adhesion width in a direction substantially perpendicular to the rolling direction of steel sheet was 2 mm and the interval was 8 mm before the annealing separator mainly composed of MgO was applied to the annealed steel sheet surface. After the application of the annealing separator mainly composed of MgO, the steel sheet was subjected to a secondary recrystallization annealing by raising its temperature from 850° C. to 1,050° C. at 10° C./hr, a purification treatment at 1,200° C. for 8 hours, a baking treatment with an insulation coating and strain relief annealing at 800° C. for 3 hours.

For comparison, the grain oriented silicon steel sheet was produced by applying an annealing separator mainly composed of MgO omitting the adhesion treatment of $Al_2O_3$ powder according to the usual manner, which was a comparative example.

Upon the examination of the coating state, a grey and homogeneous forsterite layer was formed over the front surface of the steel sheet in the comparative example, while in the areas coated with $Al_2O_3$ powder was formed a forsterite layer having a thickness less by 0.7 μm.

The magnetic properties and surface properties of these products are shown in Table 2.

TABLE 2

| | Steel ingot ingredient (wt %) | Application method of annealing separator after decarburization and primary recrystallization annealing | Magnetic properties $B_{10}$ (T) | Magnetic properties $W_{17/50}$ (W/kg) | Surface property Ratio of surface defect block produced (%) |
|---|---|---|---|---|---|
| (C) | C 0.048%, Si 3.41% Mo 0.024%, Sb 0.025%, Al 0.025%, | Mgo is uniformly applied to steel sheet | 1.94 | 0.84 | 0.4 |
| | | $Al_2O_3$ is locally applied and then | 1.94 | 0.77 | 0.5 |

TABLE 2-continued

| | Steel ingot ingredient (wt %) | Application method of annealing separator after decarburization and primary recrystallization annealing | Magnetic properties $B_{10}$ (T) | Magnetic properties $W_{17/50}$ (W/kg) | Surface property Ratio of surface defect block produced (%) |
|---|---|---|---|---|---|
| (D) | S 0.026%, C 0.052%, Si 3.38% Al 0.023%, S 0.0025% | MgO is applied Mgo is uniformly applied to steel sheet | 1.93 | 0.90 | 9 |
| | | $Al_2O_3$ is locally applied and then MgO is applied | 1.93 | 0.86 | 10 |

As seen from the magnetic properties and surface properties of the products shown in Table 2, the magnetic properties of the product made from the test steel C containing Mo therein are good and that $B_{10}$ is 1.94 T and $W_{17/50}$ is 0.84 W/kg when the MgO annealing separator is uniformly applied to the steel sheet according to the usual manner after the decarburization and primary recrystallization annealing, and the ratio of surface defects produced in the product is 0.4%. Further, when the same test steel C after the decarburization and primary recrystallization annealing is locally coated with $Al_2O_3$ and further with MgO to form a non-uniform forsterite layer thereon, it is noted that $B_{10}$ is 1.94 T, $W_{17/50}$ is 0.77 W/kg and the ratio of surface defects produced in the product is 0.5%.

On the contrary, the magnetic properties of the product made from the comparative steel D of the conventional composition are $B_{10}$ of 1.93 T and $W_{17/50}$ of 0.86~0.90 W/kg depending upon the handling conditions after the decarburization and primary recrystallization annealing and are poorer than those of the test steel C containing Mo therein, and the ratio of surface defects produced in the product is as extremely high as 9~10%.

As this point has partially been disclosed in Japanese Patent laid open No. 60-92,479, it is useful as a method of producing a low iron loss grain oriented silicon steel plate by forming areas of different thickness in the forsterite layer constituting the surface layer of the grain oriented silicon steel sheet to finely divide the width of magnetic domain.

The typically experimental details of the fifth and sixth inventions will be described below.

Each of a steel ingot (test steel E) containing C: 0.053%, Si: 3.43%, Mo: 0.026%, acid soluble Al: 0.029%, Se: 0.021% and Sb: 0.020% and a steel ingot (test steel F) containing C: 0.058%, Si: 3.49%, acid soluble Al: 0.026%, S: 0.026%, Cu: 0.1% and Sn: 0.05% was heated at 1,420° C. for 5 hours to perform the dissociation solution of inhibitor and hot rolled to form a hot rolled steel sheet of 2.0 mm in thickness.

Then, the hot rolled steel sheet was subjected to a normalized annealing at 1,080° C. for 2 minutes, quenched and subjected to two-stage cold rolling (reduction at primary cold rolling: 50%, reduction at secondary cold rolling: 80%) through an intermediate annealing at 950° C. for 3 minutes to obtain a cold rolled steel sheet having a final gauge of 0.20 mm.

In the intermediate annealing, the temperature increase from 500° C. to 900° C. was carried out by rapid heating treatment at 11° C./s, and the temperature decrease from 900° C. to 500° C. after the intermediate annealing was carried out at a cooling rate of 12° C./s.

After decarburization and primary recrystallization annealing was carried out in a wet hydrogen atmosphere at 850° C., the steel sheet was coated at its surface with an annealing separator mainly composed of MgO, and subjected to a secondary recrystallization annealing by raising the temperature from 850° C. to 1,050° C. at a heating rate of 12° C./hr and further to a purification annealing in a dry hydrogen atmosphere at 1,220° C. for 5 hours.

Thereafter, a YAG laser was irradiated to a part of the steel sheets at an interval of 8 mm in a direction perpendicular to the rolling direction of the steel sheet (laser irradiating conditions: pulse distance D=0.4 mm, interval of irradiation row l=6 mm, pulse frequency fa=8 KHz, energy per spot of steel sheet $E=3.5\times10^{-3}$J) to introduce a microstrain thereinto, which was pickled with a solution of $H_2SO_4$ (60%) at 80° C. and immersed into $SbCl_3$.

After the thus treated steel sheet was subjected to a baking treatment with an insulation coating composed mainly of phosphate and colloidal silica, it was subjected to recovery of laser irradiated position and recrystallization treatment serving as a strain relief at 800° C. for 3 hours to obtain a final product.

For comparison, the steel sheet after the finish annealing was subjected to the baking treatment with the insulation coating and further to a strain relief annealing at 800° C. for 3 hours.

The magnetic properties and surface properties of the resulting products are shown in Table 3.

TABLE 3

| | Steel ingot ingredient (wt %) | Treatment after finish annealing | Magnetic properties $B_{10}$ (T) | Magnetic properties $W_{17/50}$ (W/kg) | Surface property Ratio of surface defect block produced (%) |
|---|---|---|---|---|---|
| (E) | C 0.053%, Si 3.43% Mo 0.026%, Sb 0.029%, | Insulation coating | 1.94 | 0.84 | 0.2 |
| | | Laser irradiation → pickling → immersion in $SbCl_3$ | 1.94 | 0.76 | 0.4 |

TABLE 3-continued

| | Steel ingot ingredient (wt %) | Treatment after finish annealing | Magnetic properties $B_{10}$ (T) | Magnetic properties $W_{17/50}$ (W/kg) | Surface property Ratio of surface defect block produced (%) |
|---|---|---|---|---|---|
| | Al 0.021%, S 0.020% | solution → insulation coating | | | |
| (F) | C 0.058%, Si 3.49% | Insulation coating | 1.93 | 0.90 | 9 |
| | | Laser irradiation → pickling → immersion in $SBCl_3$ solution → insulation coating | 1.93 | 0.85 | 11 |
| | Al 0.026%, S 0.026% Cu 0.1%, Sn 0.05% | | | | |

As seen from the magnetic properties and surface properties of the product shown in Table 3, the magnetic properties of the product made from the test steel E containing Mo therein are good: a $B_{10}$ of 1.94 T and $W_{17/50}$ of 0.84 W/kg when the insulation coating is formed according to the usual manner after the finish annealing, and the ratio of surface defects produced in the product is 0.2%.

Further, when the sheet of the same test steel E after the finish annealing is subjected to laser irradiation, pickling, immersion in $SbCl_3$ solution, formation of insulation coating and recovery recrystallization annealing serving as a strain relief, the magnetic properties are very good: a $B_{10}$ of 1.94 T and $W_{17/50}$ of 0.76 W/kg, and it is noted that the ratio of surface defects produced in the product is 0.4%.

On the contrary, the magnetic properties of the product made from the comparative steel F of the conventional composition are $B_{10}$ of 1.93 T and $W_{17/50}$ of 0.85~0.90 W/kg depending upon the handling conditions after the finish annealing and are poorer than those of the test steel E containing Mo therein, and the ratio of surface defects produced in the product is as extremely high as 9~11%.

A part of the construction of the above method is a method wherein iron loss is reduced by irradiating a laser to the surface of the grain oriented silicon steel sheet after finish annealing in a direction substantially perpendicular to the rolling direction to introduce an artificial grain boundary thereinto as disclosed in Japanese Patent Application Publication No. 57-2,252, Japanese Patent Application Publication No. 57-53,419, Japanese Patent Application Publication No. 58-5,968, Japanese Patent Application Publication No. 58-26,405, Japanese Patent Application Publication No. 58-26,406, Japanese Patent Application Publication No. 58-26,407 and Japanese Patent Application Publication No. 58-36,051. However, this method locally forms high transformation density areas, so that it has a drawback that the method is merely used only at low temperature. On the other hand, the low iron loss grain oriented silicon steel sheet can advantageously be produced by a method wherein microstrain is introduced through laser irradiation, and a base metal is completely exposed through pickling to react with Sb at a high temperature, and recovery recrystallization of local areas is accelerated to form heterogeneous microareas onto the steel sheet surface. The latter method is an epoch-making method in that degradation of iron loss is not caused even when being subjected to high-temperature heating treatment, which is different from the laser irradiated product sheet as mentioned above, and a part of the construction of this method is disclosed in Japanese Patent laid open No. 60-255,926.

As mentioned above, the invention makes it possible to produce grain oriented silicon steel sheets having good iron loss and surface properties at stable steps by the addition of Mo to steel material, adoption of two-stage cold rolling process, preferably restriction of temperature rising temperature dropping rates at the intermediate annealing, and further formation of heterogeneous microareas onto the steel sheet in the decarburization and primary recrystallization annealing or after the finish annealing, which is different from the aforementioned conventional techniques in the fundamental idea and is fairly superior in the effect obtained by the adoption of these steps as compared with the conventional techniques.

In each of the above inventions, Si is an element effective for increasing the electrical resistance of silicon steel sheet to reduce eddy current loss as previously mentioned, and is particularly required to be not less than 3.1 wt % for reducing the iron loss of the thinned product. However, when the Si amount exceeds 4.5 wt %, a brittle fracture is apt to be caused in the cold rolling, so that the Si amount is limited to a range of 3.1~4.5 wt %. On the other hand, the Si amount in the conventional grain oriented silicon steel sheet utilizing AlN as an inhibitor is about 2.8~3.0 wt %, but if the Si amount is increased, the surface properties of the product as in the comparative steels I, III of FIGS. 1, 3 are considerably degraded. In each of the first, second inventions, the prevention on the occurrence of surface defects is made possible by adding 0.003~0.1 wt % of Mo to the steel material.

When the amount of Mo added to the steel material is less than 0.003 wt %, the force improving the magnetic properties and preventing the occurrence of surface defects is weak, while when it exceeds 0.1%, the decarburization in steel is delayed at the decarburization step, so that the amount should be limited to a range of 0.003~0.1 wt %.

A forms a fine precipitate of AlN by bonding to N contained in the steel, and acts as a strong inhibitor. Particularly, in order to grow secondary recrystallized grains highly aligned in Goss orientation in the production of grain oriented silicon steel thin sheet, acid soluble Al is necessary to be within a range of 0.005~0.06 wt %.

When the amount of acid soluble Al is less than 0.005 wt %, the precipitated amount of AlN fine precipitates as an inhibitor is lacking and the growth of secondary recrystallized grains in [110]<001> orientation is insufficient, while when it exceeds 0.06 wt %, the growth of secondary recrystallized grains in [110]<001> orientation is also considerably degraded.

S and Se form dispersed precipitation phases of MnS or MnSe together with AlN to promote the inhibitor effect. If the amount of S or Se in total is less than 0.005 wt %, the inhibitor effect of MnS or MnSe is weak, while when the total amount exceeds 0.1 wt %, the hot and cold workabilities are considerably degraded, so that the amount of at least one of S, Se in total should be within a range of 0.005~0.1 wt %. Even in such a total amount range, if the S amount is less than 0.005 wt %, or if the Se amount is less than 0.003 wt %, the inhibitor effect is lacking, while if each of the amounts exceeds 0.05 wt %, the hot and cold workabilities are degraded, so that it is desirable that the S amount is within a range of 0.005~0.05 wt % and the Se amount is within a range of 0.003~0.05 wt %.

In each of the second, fourth and sixth inventions, it is particularly expected that Sb functions for the control of primary recrystallized grain growth. When the amount is less than 0.005 wt %, the effect is small, while when it exceeds 0.2 wt %, the magnetic flux density is lowered to reduce the magnetic properties, so that the amount should be within a range of 0.005~0.2 wt %.

As the steel material adaptable for the method of each invention, it is necessary to contain 3.1~4.5% of Si and small amounts of Mo, Al, S and Se and further Sb as mentioned above, but there is no obstacle to the presence of other well-known elements added to ordinary silicon steel.

For instance, it is preferable to include about 0.02~2 wt % of Mn.

Further, C is required to produce $\gamma$ transformation in a part of the steel sheet during the annealing of the hot rolled steel sheet in connection with the fine precipitation of AlN. The C content is suitable within a range of about 0.030~0.080 wt % when the Si content is within a range of 3.1~4.5 wt % according to the invention.

Moreover, at least one of Sn, Cu and B added to ordinary silicon steel as a well-known inhibitor for primary recrystallized grain growth may be contained in a total amount of not more than 0.5 wt %, and also it is generally accepted to include a slight amount of inevitable elements such as Cr, Ti, V, Zr, Nb, Ta, Co, Ni, P, As and so on.

The invention will be described with reference to a series of production steps below.

At first, an LD converter, open hearth and other well-known steel making processes can be used as a means for melting the steel material used in the method according to the invention. It is a matter of course that the above means may be used together with vacuum treatment or vacuum dissolution.

As a means for the production of slabs, the usual ingot making-bloom rolling as well as continuous casting may preferably be used.

The thus obtained silicon steel slab is heated in the well-known manner and then subjected to hot rolling. The thickness reduction obtained by the hot rolling is different from the reduction of the subsequent cold rolling step, but it is usually desirable to be about 1.5~3.0 mm.

According to the invention, the addition of a small amount of Mo to the steel material is an essential feature for obtaining silicon steel sheets having good surface properties. As disclosed in Japanese Patent laid open No. 59-85,820 by the inventors, a means for enriching Mo in the surface layer of the steel sheet by applying an Mo compound to the surface up to the completion of the hot rolling may naturally be used.

Then, the hot rolled steel sheet after the completion of the hot rolling is subjected to a primary cold rolling. According to circumstances, the steel sheet is subjected to a normalized annealing within a temperature range of 900°~1,200° C. and a quenching treatment for obtaining finely uniformized dispersion of C into the hot rolled steel sheet before the primary cold rolling.

The reduction at primary cold rolling is somewhat different in accordance with the gauge of the product, but it is limited to 10~60% (desirably 20~50%) for obtaining a thinned product having good properties according to the invention as seen from FIGS. 1 and 3.

The intermediate annealing is carried out at a temperature of 900°~1,100°C. for about 30 seconds ~30 minutes. In order to stably obtain good magnetic properties, it is desirable that the temperature increase from 500° C. to 900° C. and the temperature decrease from 900° C. to 500° C. after the intermediate annealing are carried out at a rate of not less than 5° C./s, preferably not less than 10° C./s. Such rapid heating and rapid cooling treatments may be performed by a well-known means such as a continuous furnace, a batch furnace or the like.

The secondary cold rolling is adapted at a reduction of 75~90% as seen from FIGS. 1 and 3, whereby a cold rolled steel sheet having a final gauge of 0.1~0.25 mm is finished.

Each embodiment of the invention produces high magnetic flux density electromagnetic steel thin sheets. The steel sheets having good properties are obtained by finishing the hot rolled steel sheet of about 1.5~3.0 mm in thickness at the reduction of each of the cold rolling and secondary cold rolling shown in FIGS. 1 and 3 into a cold rolled steel thin sheet having a final gauge of 0.1~0.25 mm.

In this case, an ageing treatment at 50°~600° C. may be performed through plural passes as disclosed in Japanese Patent Application Publication No. 54-13,866.

The thus cold rolled thin sheet of 0.1~0.25 mm in gauge is subjected to decarburization annealing serving as a primary recrystallization within a temperature range of about 750°~870° C. The decarburization annealing may usually be performed in a wet hydrogen atmosphere having a dew point + about 30°~65° C. or in a mixed gas atmosphere of hydrogen nitrogen for several minutes.

Then, the steel sheet after the decarburization annealing is coated with an annealing separator mainly composed of MgO and subjected to finish annealing to grow secondary recrystallized grains in [110]<001> orientation. The concrete conditions for the finish annealing may be the same as in the well-known cases, but it is usually desirable that the secondary recrystallized grains are grown by raising the temperature to 1,150°~1,250° C. at a temperature increase rate of 3°~50° C./h and then purification annealing is carried out in a dry hydrogen atmosphere for 5~20 hours.

Although the steel sheet of final product gauge after the final cold rolling is subjected to a surface degreasing treatment and further to decarburization and primary recrystallization annealing, a treatment for forming heterogeneous microareas onto the steel sheet surface through subsequent high-temperature finish annealing is performed before or after the decarburization and primary recrystallization annealing, and then high-temperature finish annealing is performed as previously mentioned in the third and fourth embodiments, or laser irradiation is performed as mentioned in the fifth and sixth embodiments, whereby low iron loss grain oriented silicon steel sheets can be produced.

As previously mentioned, the treatment for the formation of heterogeneous microareas can be accomplished by the following methods:

(1) The decarburization promotion areas or decarburization delay areas are formed on the steel sheet surface by applying a coating agent in a direction substantially perpendicular to the rolling direction in the decarburization and primary recrystallization annealing.

(2) A microstrain is introduced into the steel sheet surface after high-temperature finish annealing or areas acting at different tensions are formed thereon at local positions by laser, by discharge working, by a scriber or by a ballpen-like microsphere.

(3) Uneven temperature areas are formed on the steel sheet surface at local positions by heat treatment.

In the method (1), the decarburization promotion area and decarburization delay area are alternately formed on the steel sheet surface at substantially an equal width every interval of 1~50 mm as previously disclosed in Japanese Patent laid open No. 60-39,124. The narrower the width of these areas, the finer the primary recrystallized texture, and hence the secondary recrystallized grain becomes finer. Since the secondary recrystallized grain size of the product is usually within a range of 1.5~25 mm, when the primary recrystallized texture is varied on the steel sheet surface at a width corresponding to not more than 2 times the secondary recrystallized grain size or a width of 3~50 mm, it is possible to obtain finer secondary recrystallized grains.

The effect of applying the coating agent to the steel sheet surface is sufficiently developed even at face of the sheet, but it is more enhanced when applied to both-side surfaces of the steel sheet. As the application method to the steel sheet surface, it is considered that application with a grooved or uneven rubber roll is optimum, but a spraying method after the covering the unnecessary area with a masking plate may be used.

Moreover, the coating solution for forming the decarburization promotion area and decarburization delay area on the steel sheet surface may be prepared according to the teaching published by the inventors (Y. Inokuti: Trans. ISIJ, Vol. 15 (1975), P. 324), which is quoted below by way of precaution. Decarburization promotion agent: $MgCl_2.6H_2O$, $Mg(NO_3)_2.6H_2O$, $CaCl_2.2H_2O$, $Ca(NO_3)_2.4H_2O$, $SrCl_2.2H_2O$, $Sr(NO_3)_2.4H_2O$, $BaCl_2.2H_2O$, $Ba(NO_3)_2$, $KC^l$, $KMnO_4$, $K_2P_2O_7$, KBr, $KClO_3$, $KBrO_3$, KF, NaCl, $NaIO_4$, NaOH, $NaHPO_4$, $NaH_2PO_4.2H_2O$, NaF, $NaHCO_3$.-$Na_2O_5$, $Na_4P_2O_7.10H_2O$, NaI.$(NH_4)_2Cr_2O_7$, $Cu(NO_3)_2.3H_2O$, $Fe(NO_3)_3.9H_2O$, $Co(NO_3)_2.6H_2O$ $Ni(NO_3)_2.6H_2O$, $Pd(NO_3)_2$, $Zn(CH_3COO)$, $Zn(NO_3)_2.6H_2O$ and so on. Decarburization delay agent: $K_2S$, $Na_2S_2O_3.5H_2O$, $Na_2S.9H_wO$, $MgSO_4$, $SrSO_4$, $Al_2(SO_4)_3.18H_2O$, S2Cl2, $NaHSO_3$, $FeSO_4.7H_2O$, $KHSO_4$, $Na_2S_2O_8$, $K_2S_2O_7$, $Ti(SO_4)_2.3H_2O$, $CuSO_4.5H_2O$, $ZnSO_4.7H_2O$, $CrSO_4.7H_2O$, $(NH_4)_2S_2O_8$, $H_2SO_4$, $H_2SeO_3$, $SeOCl_2$, $Se_2Cl_2$, $H_2SeO_4$, $K_2Se$, $Na_2Se$, $Na_2SeO_3$, $K_2SeO_3$, $Na_2SeO_4$, $K_2SeO_4$, $H_2TeO_4.2H_2O$, $Na_2TeO_3$, $K_2TeO_3$, $K_2TeO_4.3H_2O$, $TeCl_4$, $Na_2TeO_4$, $Na_2AsO_2$, $H_3AsO_4$, $AsCl_3$, $(NH_4)_3AsO_4$, $KH_2AsO_4$, SbOCl, $SbCl_3$, $SbBr_3$, $Sb_2(SO_4)_3$, $Sb_2O_3$, $BiCl_3$, $Bi(OH)_3$, $BiF_3$, $NaBiO_3$, $Bi_2(SO_4)_3$, $SnCl_2.2H_2O$, $SnI_2$, $PbCl_2$, $PbO(OH)_2$, $Pb(NO_3)_2$ and so on.

Therefore, it is clear that the non-treated area is formed as a delay area in the treatment using only the former agent or as a promotion area in the treatment using only the latter agent.

The method of forming the microareas on the steel sheet surface after the decarburization and primary recrystallization annealing with a secondary recrystallization promoting or controlling agent may be performed according to the teaching of Japanese Patent laid open No. 60-89,521, which is quoted below by way of precaution.

(a) Secondary recrystallization promoting agents of S, Se, Te, As, Sb, Bi, Sn and Pb:

S compound: $K_2S$, $Na_2S_2O_3.5H_2O$, $Na_2S.9H_2O$, $MgSO_4$, $SrSO_4$, $Al_2(SO_4)_3.18H_2O$, $S_2Cl_2$, $NaHSO_3$, $FeSO_4.7H_2O$, $KHSO_4$, $Na_2S_2O_8$, $K_2S_2O_7$, $Ti(SO_4)_2.3H_2O$, $CuS0_4.5H_2O$, $ZnSO_4.7H_2O$, $CrSO_4.7H_2O$, $(NH_4)_2S_2O_8$, $H_2SO_4$ Se compound: $H_2SeO_3$, $SeOCl_2$, $Se_2Cl_2$, $SeO_2$, $H_2SeO_4$, $K_2Se$, $Na_2Se$, $Na_2SeO_3$, $K_2SeO_3$, $Na_2SeO_4$, $K_2SeO_4$ Te compound: $H_2TeO_4.2H_20$, $Na_2TeO_3$, $K_2TeO_3$, $K_2TeO_4.3H_2O$, $TeCl_4$, $Na_2TeO_4$ As compound: $Na_2AsO_2$, $H_3AsO_4$, $AsCl_3$, $(NH_4)_3AsO_4$, $KH_2AsO_4$ Sb compound: SbOCl, $SbCl_3$, $SbBr_3$, $Sb_2(SO_4)_3$, $Sb_2O_3$ Bi compound: $BiCl_3$, $Bi(OH)_3$, $BiF_3$, $NaBiO_3$, $Bi_2(SO_4)_3$ Sn compound: $SnCl_2.2H_2O$, $SnI_2$ (b) Secondary recrystallization controlling agents of Ce, C, Na, K, Mg and Sr:

Ce compound: $CeO_2$, $Ce(NO_3)_2.6H_2O$, $CeCl_3.7H_2O$

Ca compound: $CaCl_2$, $Ca(NO_3)_3.6H_2O$, $CaHPO_4.2H_2O$

Na compound: NaOH, NaCl, $Na_2HPO_4$, $Na_2Cr_2O_7.2H_2O$, $Na_4P_2O_7.1OH_2O$, $NaHCO_3$, $NaIO_4$ K compound: $KNO_2$, KCl, $KMnO_4$, $KNO_3$, $KClO_3$ Mg compound: $MgCl_2.6H_2O$, $Mg(NO_3)_2.6H_2O$ Sr compound: $SrCl_2.2H_2O$, $Sr(NO_3)_2.4H_2O$ Ba compound: $BaCl_2.2H_2O$, $Ba(NO_3)_2$ In method (2), the conditions for the introduction of microstrain through, for example, laser treatment are sufficient according to the teachings of the well-known articles (Japanese Patent laid open No. 60-96,720 and the like). By way of precaution, the preferred conditions are mentioned as follows:

As the laser, YAG laser pulse generating multimode is optimum. The preferable irradiation conditions of laser treatment for steel sheet surface are

| | |
|---|---|
| Pulse interval | D = 0.2~0.6 mm |
| Space between irradiated rows in rolling direction | l = 4~15 mm |
| Pulse frequency | $f_Q$ = not more than 10 KHz |
| Energy per steel surface area | U = 1.0~3.0 mJ/mm$^2$ |

On the other hand, the conditions for the introduction of microstrain through discharge working treatment are sufficient according to the teachings of the well-known articles (Japanese Patent Application Publication No. 57-18,810 and the like). By way of precaution, the preferred conditions are mentioned as follows.

| | |
|---|---|
| Width or diameter of | d = 0.004~2 mm |

-continued

| | |
|---|---|
| discharge trace | |
| Interval between discharge traces on steel sheet | D = 0.1~0.8 mm |
| Space between discharge rows in rolling direction | l = 5~15 mm |

Moreover, the conditions for the introduction of microstrain at local positions through scriber (pushing) or ballpen-like microsphere are sufficient according to the teaching of the well-known article (Japanese Patent Application Publication No. 58-59,68). By way of precaution, the preferred conditions are mentioned as follows.

| | |
|---|---|
| Interval between depressions on steel sheet surface | 1~15 mm |
| Depth of depression from steel sheet surface | not more than 5 μm |
| Width of depression on steel sheet surface | 10~100 μm |

The method (3), i.e. the formation of temperature differences on the steel sheet surface through heat treatment may be performed according to the teachings of the well-known articles (Japanese Patent laid open No. 60-103,132 and the like). By way of precaution, the preferred conditions are mentioned as follows.

| | |
|---|---|
| Difference between temperature of high temperature treated steel sheet and usual annealing temperature | 15~100° C. |
| High-temperature area of steel sheet surface | width of 2~25 mm |
| Area treated at usual annealing temperature | width of 2~25 mm |

The method for non-uniform heat treatment through: these repeated annealing treatments (for example, Japanese Patent laid open No. 59-100,221, Japanese Patent laid open No. 59-100,222, Japanese Patent laid open No. 60-103,120 and the like) may be performed by any one of conventional well-known means such as local heating with flash lamps, infrared ray lamps, high frequency induction heating, pulse type heat treatment and so on.

In case of the method (1) among the above methods, the annealing separator mainly composed of MgO is applied to the treated steel sheet surface and then the high-temperature finish annealing is performed to grow the secondary recrystallized grains strongly aligned in [110]<001> orientation. The concrete conditions of the finish annealing may be the same as in the conventional well-known annealing method, but it is usually desirable that the temperature is raised up to 1,150°~1,250° C. at a temperature rising rate of 3°~50° C./hr to grow the secondary recrystallized grains and then purification annealing is carried out in a dry hydrogen atmosphere for 5~20 hr.

Onto the forsterite layer at the steel sheet surface after the finish annealing is formed an insulation coating for guaranteeing sure insulation. In this case, as previously disclosed in the fifth and sixth embodiments of the invention, heterogeneous microareas are formed onto the finish annealed steel sheet surface to produce low iron loss grain oriented silicon steel sheets.

In this case, the introduction of artificial grain boundary through laser irradiation process disclosed in Japanese Patent Application Publication No. 57-2,252, Japanese Patent Application Publication No. 57-53,419, Japanese Patent Application Publication No. 58-5,968, Japanese Patent Application Publication No. 58-26,405, Japanese Patent Application Publication No. 58-26,406, Japanese Patent Application Publication No. 58-26,407, Japanese Patent Application Publication No. 58-36,051 has a drawback that it is merely used stably at only a low temperature, so that it is necessary to adopt a method of forming non-homogeneous areas onto the steel sheet surface without degrading the magnetic properties even after the high-temperature strain relief annealing step.

For the formation of heterogeneous microareas without degradation of magnetic properties even after the high-temperature annealing, there may be used the following methods:

a. Areas having different thicknesses of forsterite layer are formed onto the steel sheet surface;
b. A coating having a different tension is formed on the forsterite layer;
c. After the forsterite layer is locally removed by using a layer or the like as mentioned above, the formed local areas are subjected to recovery.recrystallization treatment serving as a strain relief annealing to form non-uniform areas.

The method may be performed according to the method previously disclosed in Japanese Patent laid open No. 60-92,479. By way of precaution, there are mentioned the following four methods:

a-i) Locally adhering a substance inhibiting reaction with the annealing separator to the steel sheet surface in an amount of not more than 1 g/m$^2$ prior to the application of annealing separator at the step for applying the annealing separator to the steel sheet surface after the primary recrystallization annealing.

In this method, oxides such as $SiO_2$, $Al_2O_3$, $ZrO_2$ and so on as well as metals such as Zn, Al, Sn, Ni, Fe and so on are mentioned as a reaction inhibiting substance. When the amount of the reaction inhibiting substance adhered exceeds 1 g/m$^2$, the reaction inhibiting effect becomes excessive and the forsterite layer is not formed. Therefore, it is necessary to control the amount of forsterite layer thickness reduced by limiting the amount of the reaction inhibiting substance to not more than 1 g/m$^2$. Moreover, anyone of applications such as spraying, plating, printing, static painting and the like may be utilized as a means for adhering the reaction inhibiting substance to the steel sheet.

a-ii) Locally adhering a water repellent substance against an annealing separator slurry (suspension of water and annealing separator) to the steel sheet surface in an amount of not more than 0.1 g/m$^2$ prior to the application of annealing separator at the step for applying the annealing separator to the steel sheet surface after the primary recrystallization annealing.

As the water repellent substance, oil paint, varnish and the like are advantageously adaptable. This substance inhibits the contact between the steel sheet surface and the annealing separator to delay the reaction of forsterite formation and form the reduced area of forsterite thickness. However, when the amount of the substance adhered exceeds 0.1 g/m$^2$, the reaction delaying effect becomes excessive to form no forsterite layer, so that it is necessary to control the reduced amount of forsterite layer thickness by limiting the amount of the substance to not more than 0.1 g/m$^2$. Moreover, as a means for adhering the water repellent substance to the steel sheet, spraying, printing, static painting and the like may be used likewise in the case of using the aforementioned reaction inhibiting substance. a-iii) Locally adhering a substance as an oxidant for Si in steel to the steel sheet surface in an amount of not more than 2 $g/m^2$ prior to the application of annealing separator at the step for applying the annealing separator to the steel sheet surface after the primary recrystallization annealing.

This substance oxidizes Si in steel at a high temperature in the subsequent finish annealing step to increase the amount of $SiO_2$ grains in subscale of steel sheet surface, whereby the thickness of forsterite layer after the finish annealing is increased to locally form a thickness increased layer on the steel sheet surface. As the oxidizer, oxides such as FeO, $Fe_2O_3$, $TiO_2$ and so on, reducible silicates such as $Fe_2SiO_4$ and so on, hydroxides such as $Mg(OH)_2$ and so on are advantageously adaptable. When the amount of the oxidizer adhered exceeds 2 $g/m^2$, the layer thickness becomes too thick to lose the adhesion force to the steel sheet and peel off the layer, and consequently the given object can not be achieved.

a-iv) Method of forming the thickness-reduced areas by removing the forsterite layer formed on the steel sheet surface after the secondary recrystallization so as not to apply plastic strain to the surface of base metal.

As such a method, there are chemical polishing and electrolytic polishing as well as removal with rotating conical whetstone, removal with iron needle under a light pressure, optical removal with a laser beam having a properly adjusted output and the like. Particularly, when the laser beam is used as the optical removal means, it has an advantage that a plurality of different thickness areas can efficiently be formed at a single operation by taking plural beams from a light source or irradiating the beam over the whole surface in the presence of a proper masking.

In the method b, i.e. the method of forming different tension coatings on the forsterite layer, the thermal expansion coefficient of the insulation coating is not more than $8.5\times10^{-6}$ 1/° C. and the coefficient between different coatings is not less than 1.1 as disclosed in Japanese Patent laid open No. 60-103,182, which may be achieved by alternately applying and baking the conventionally known different coating solutions at an interval of 1~30 mm.

In the method c as disclosed in Japanese Patent laid open No. 60-255,926 or Japanese Patent laid open No. 60-89,545, the steel sheet layer is peeled off from the steel sheet surface after the finish annealing by means of a laser or a means for application of stress such as scriber, and a part of the base metal is removed with an acid such as hydrochloric acid, nitric acid or the like, and then the treated steel sheet is immersed in an aqueous solution of an inorganic compound containing a semi-metal, a metal or the like to fill in the removed portion, which is thereafter subjected to recovery recrystallization annealing serving as a strain relief annealing to form non-uniform areas.

Further, in order to guarantee sure insulating property, an insulation coating composed mainly of phosphate and colloidal silica is applied and baked to the above treated sheet. It is naturally required for use in transformers having a capacity as large as 1,000,000 KVA. The formation of such an insulation coating may be performed by using the conventionally well-known process as it is.

After the formation of such an insulation coating, the strain relief annealing is carried out at a temperature of not lower than 600° C. The method according to the invention has a characteristic that the degradation of magnetic properties is not caused even after such a high-temperature annealing.

EXAMPLE 1

A continuously cast slab containing C: 0.059%, Si: 3.49%, Mo: 0.024%, acid soluble Al: 0.034%, S: 0.029% was heated at 1,430° C. for 3 hours and hot rolled to form a hot rolled steel sheet of 2.2 mm in thickness. Thereafter, the steel sheet was subjected to a primary cold rolling at a reduction of about 50% and further to an intermediate annealing at 1,100° C. for 3 minutes. In the intermediate annealing, rapid heating treatment of 12° C./s was performed from 500° C. to 900° C., and rapid cooling treatment of 15° C./s was performed from 900° C. to 500° C. after the intermediate annealing.

Thereafter, the steel sheet was subjected to a cold rolling at a reduction of about 80% to obtain a cold rolled steel sheet having a final gauge of 0.20 mm, which was then subjected to a primary recrystallization annealing serving as a decarburization in a wet hydrogen atmosphere at 830° C.

After a secondary recrystallization was carried out by raising temperature from 850° C. to 1,100° C. at 10° C./hr, a purification annealing was performed in a dry hydrogen atmosphere at 1200° C. for 10 hours.

The magnetic properties and surface properties of the resulting product were as follows.

The magnetic properties were $B_{10}$:1.93 T and $W_{17/50}$:0.80 w/kg, and the surface properties were very good as the ratio of surface defect block produced was 0.8%.

EXAMPLE 2

A continuously cast slab containing C: 0.064%, Si: 3.39%, Mo: 0.019%, acid soluble Al: 0.029%, Se: 0.020%, Sb: 0.022% was heated at 1,420° C. for 4 hours and hot rolled to a thickness of 2.2 mm. Thereafter, the steel sheet was subjected to a primary cold rolling at a reduction of about 40% and further to an intermediate annealing at 1,100° C. for 2 minutes. In the intermediate annealing, rapid heating treatment of 12° C./s was performed from 500° C. to 900° C., and rapid cooling treatment of 18° C./s was performed from 900° C. to 500° C. after the intermediate annealing.

Thereafter, the steel sheet was subjected to a secondary cold rolling at a reduction of about 83% to obtain a cold rolled steel sheet having a final gauge of 0.23 mm, which was then subjected to decarburization and primary recrystallization annealing in a wet hydrogen atmosphere at 840° C.

After an annealing separator mainly composed of MgO was applied to the steel sheet surface, a secondary recrystallization was performed by raising temperature from 850° C. to 1,100° C. at 10° C./hr, and then a purification annealing was performed in a dry hydrogen atmosphere at 1,200° C. for 15 hours. The magnetic properties and surface properties of the resulting product were as follows.

The magnetic properties were $B_{10}$:1.93 T and $W_{17/50}$:0.80 w/kg, and the surface properties were very good as the ratio of surface defect block produced was 0.6%.

EXAMPLE 3

A steel ingot containing C: 0.058%, Si: 3.59%, Mo: 0.035%, acid soluble Al: 0.033%, S: 0.023%, Cu: 0.15%, Sn: 0.11% was hot rolled to form a hot rolled steel sheet of 2.0 mm in thickness, which was then subjected to a primary cold rolling (reduction: about 40%). Thereafter, the steel sheet was subjected to an intermediate annealing at 1,050° C. for 5 minutes, wherein the temperature rising from 500° C. to 900° C. was performed by rapid heating treatment of 18° C./s and the temperature dropping from 900° C. to 500° C. was performed by rapid cooling treatment of 20° C./s.

Next, the steel sheet was subjected to a strong cold rolling at a reduction of about 89% to obtain a cold rolled steel sheet having a final gauge of 0.17 mm, during which a warm rolling at 300° C. was performed. Then, the steel sheet was subjected to decarburization and primary recrystallization annealing in a wet hydrogen atmosphere at 840° C., a secondary recrystallization by raising temperature from 850° C. to 1,100° C. at 15° C./hr, and a purification annealing in a dry hydrogen atmosphere at 1,200° C. for 15 hours. In the resulting product, the magnetic properties were $B_{10}$:1.93 T and $W_{17/50}$:0.76 w/kg, and the surface properties were good as the ratio of surface defect block produced was 0.9%.

EXAMPLE 4

A continuously cast slab containing C: 0.064%, Si: 3.45%, Mo: 0.025%, acid soluble Al: 0.025%, S: 0.028% was heated at 1420° C. for 4 hours and hot rolled to form a hot rolled steel sheet of 2.2 mm in thickness. Then, the steel sheet was subjected to a primary cold rolling at a reduction of about 30% and further to an intermediate annealing at 1,080° C. for 3 minutes. In the intermediate annealing, rapid heating treatment of 13° C./s was performed from 500° C. to 900° C., and rapid cooling treatment of 18° C./s was performed from 900° C. to 500° C.

Then, the steel sheet was subjected to a cold rolling at a reduction of about 85% to obtain a cold rolled steel sheet having a final gauge of 0.23 mm. After the steel sheet (surface temperature: 70° C.) was degreased, an aqueous diluted solution of $MgSO_4$ (0.01 mol/l) at 85° C. was applied by spraying with a jig of 0.5 mm in width at an interval of 5 mm in a direction substantially perpendicular to the rolling direction to alternately form the applied areas and non-applied areas, which was then subjected to decarburization and primary recrystallization annealing in a wet hydrogen atmosphere at 840° C. After the application of an annealing separator mainly composed of MgO, the steel sheet was slowly heated from 850° C. to 1,100° C. at 10° C./hr and then subjected to a purification annealing in a hydrogen atmosphere at 1,200° C. for 10 hours. The magnetic properties and surface properties of the resulting product were as follows.

The magnetic properties were $B_{10}$:1.93 T and $W_{17/50}$:0.82 w/kg, and the surface properties were very good as the ratio of surface defect block produced was 1.2%.

EXAMPLE 5

A continuously cast slab containing C: 0.066%, Si: 3.5%, Mo: 0.035%, acid soluble Al: 0.030%, S: 0.026%, Sb: 0.026%, Sn: 0.1%, Cu: 0.1% was heated at 1,430° C. for 4 hours and hot rolled to form a hot rolled steel sheet of 2.2 mm in thickness. Then, the steel sheet was subjected to a primary cold rolling at a reduction of about 40% and further to an intermediate annealing at 1,050° C. for 5 minutes. In the intermediate annealing, rapid heating treatment of 15° C./s was performed from 500° C. to 900° C., and rapid cooling treatment of 20° C./s was performed from 900° C. to 500° C. after the intermediate annealing.

Next, the steel sheet was subjected to a cold rolling at a reduction of about 85% to obtain a cold rolled steel sheet having a final gauge of 0.20 mm, during which a warm rolling at 250° C. was performed.

After the steel sheet surface was degreased and held at a surface temperature of about 100° C., a mixed solution of $MgSO_4$ (0.01 mol/l) and $Mg(NO_3)_2$ (0.01 mol/l) (90° C.) was applied to the steel sheet surface with a rubber roll having an uneven surface to alternately form the applied areas and non-applied areas, which was then subjected to decarburization and primary recrystallization annealing in a wet hydrogen atmosphere at 850° C. After the application of an annealing separator mainly composed of MgO, the steel sheet was slowly heated from 850° C. to 1,100° C. at 8° C./hr and subjected to a purification annealing in a hydrogen atmosphere at 1,200° C. for 10 hours. The magnetic properties and surface properties of the resulting product were as follows.

The magnetic properties were $B_{10}$:1.94 T and $W_{17/50}$:0.73 w/kg, and the surface properties were very good as the ratio of surface defect block produced was 1.2%.

EXAMPLE 6

A continuously cast slab containing C: 0.058%, Si: 3.40%, Mo: 0.026%, Se: 0.021%, acid soluble Al: 0.030%, Sb: 0.025% was heated at 1,430° C. for 3 hours and hot rolled to form a hot rolled steel sheet of 2.2 mm in thickness. Then, the steel sheet was subjected to a primary cold rolling at a reduction of about 50% and further to an intermediate annealing at 1,100° C. for 3 minutes. In the intermediate annealing, rapid heating treatment of 12° C./s was performed from 500° C. to 900° C., and rapid cooling treatment of 15° C./s was performed from 900° C. to 500° C. after the intermediate annealing.

Thereafter, the steel sheet was subjected to a cold rolling at a reduction of about 80% to obtain a cold rolled steel sheet having a final gauge of 0.20 mm, which was then subjected to a primary recrystallization annealing serving as a decarburization in a wet hydrogen atmosphere at 830° C.

Prior to the application of an annealing separator mainly composed of MgO, $Al_2O_3$ powder as a reaction inhibiting substance against the annealing separator and $SiO_2$ in subscale of steel sheet was linearly adhered to the steel sheet surface under conditions that adhesion amount=0.3 g/m$^2$, adhesion width in a direction substantially perpendicular to the rolling direction of steel sheet: 1.5 mm, and repeated space: 8 mm, and thereafter the annealing separator mainly composed of MgO was applied thereto.

Thereafter, the steel sheet was subjected to a secondary recrystallization by raising temperature from 850° C. to 1,100° C. at 10° C./hr and further to a purification annealing in a hydrogen atmosphere at 1,200° C. for 10 hours. In the steel sheet surface after the finish annealing, the forsterite layer having a thickness thinner by 0.6 μm was formed on the area coated with $Al_2O_3$ powder.

After an insulation coating composed mainly of phosphate and colloidal silica was baked on the forsterite layer, the strain relief annealing was performed at 800° C. for 3 hours. The magnetic properties and surface properties of the resulting product were as follows.

The magnetic properties were $B_{10}$:1.94 T and $W_{17/50}$:0.78 w/kg, and the surface properties were very good as the ratio of surface defect block produced was 0.9%.

EXAMPLE 7

A continuously cast slab containing C: 0.054%, Si: 3.36%, Mo: 0.024%, acid soluble Al: 0.025%, Se: 0.020% was heated at 1,420° C. for 4 hours and hot rolled to form a hot rolled steel sheet of 2.2 mm in thickness. Then, the steel sheet was subjected to a primary cold rolling at a reduction of about 40% and further to an intermediate annealing at 1,100° C. for 2 minutes. In the intermediate annealing, rapid heating treatment of 12° C./s was performed from 500° C. to 900° C., and rapid cooling treatment of 18° C./s was performed from 900° C. to 500° C. after the intermediate annealing.

Thereafter, the steel sheet was subjected to a secondary cold rolling at a reduction of about 83% to obtain a cold rolled steel sheet having a final gauge of 0.23 mm, which was then subjected to decarburization and primary recrystallization annealing in a wet hydrogen atmosphere at 840° C.

Next, a pulse laser was irradiated linearly (line width: 0.3 mm) at an interval of 8 mm in a direction perpendicular to the rolling direction, and thereafter a solution of $SbCl_3$ (0.01 mol/l, 90° C.) was applied at the laser irradiated position.

After an annealing separator mainly composed of MgO was applied to the steel sheet surface, a secondary recrystallization was performed by raising temperature from 850° C. to 1,100° C. at 10° C./hr, and then a purification annealing was performed in a dry hydrogen atmosphere at 1,200° C. for 15 hours.

After the formation of an insulation coating composed mainly of phosphate and colloidal silica, the steel sheet was subjected to a strain relief annealing at 800° C. for 2 hours. The magnetic properties and surface properties of the resulting product were as follows.

The magnetic properties were $B_{10}$:1.94 T and $W_{17/50}$:0.79 w/kg, and the surface properties were very good as the ratio of surface defect block produced was 0.8%.

EXAMPLE 8

A steel ingot containing C: 0.054%, Si: 3.49%, Mo: 0.025%, acid soluble Al: 0.030%, S: 0.022% Cu: 0.15%, Sn: 0.10% was hot rolled to form a hot rolled steel sheet of 2.0 mm in thickness, which was subjected to a primary cold rolling (reduction: about 40%). Then, the steel sheet was subjected to an intermediate annealing at 1,050° C. for 5 minutes, wherein the temperature rising from 500° C. to 900° C. was carried out by rapid heating treatment of 18° C./s, and the temperature dropping from 900° C. to 500° C. after the intermediate annealing was carried out by rapid cooling treatment of 20° C./s.

Thereafter, the steel sheet was subjected to a strong cold rolling at a reduction of about 89% to obtain a cold rolled steel sheet having a final gauge of 0.17 mm, during which a warm rolling at 300° C. was performed. Then, the steel sheet was subjected to decarburization and primary recrystallization annealing in a wet hydrogen atmosphere at 840° C., before which an electron beam was scanned at a width of 0.5 mm and an interval of 12 mm in a direction perpendicular to the rolling direction to form ununiform heat areas.

After an annealing separator mainly composed of MgO was applied to the steel sheet surface, a secondary recrystallization was performed by raising temperature from 850° C. to 1,100° C. at 15° C./hr, and a purification annealing was performed in a dry hydrogen atmosphere at 1,200° C. for 15 hours.

After the baking of an annealing separator composed mainly of phosphate and colloidal silica, a strain relief annealing was performed at 800° C. for 5 hours. In the resulting product, the magnetic properties were $B_{10}$:1.94 T and $W_{17/50}$:0.77 w/kg, and the surface properties were very good as the ratio of surface defect block produced was 1.2%.

EXAMPLE 9

A continuously cast slab containing C: 0.057%, Si: 3.35%, Mo: 0.025%, acid soluble Al: 0.020%, Se: 0.022%, Sb: 0.023% was heated at 1,420° C. for 4 hours and hot rolled to form a hot rolled steel sheet of 2.2 mm in thickness. Then, the steel sheet was subjected to a primary cold rolling at a reduction of about 30% and further to an intermediate annealing at 1,080° C. for 3 minutes. In the intermediate annealing, rapid heating treatment of 13° C./s was performed from 500° C. to 900° C., and rapid cooling treatment of 18° C./s was performed from 900° C. to 500° C. after the intermediate annealing.

Thereafter, the steel sheet was subjected to a cold rolling at a reduction of about 85% to obtain a cold rolled steel sheet having a final gauge of 0.23 mm, which was then subjected to decarburization and primary recrystallization annealing in a wet hydrogen atmosphere at 840° C. After the application of an annealing separator mainly composed of MgO, the steel sheet was slowly heated from 850° C. to 1,100° C. at 10° C./hr and subjected to a purification annealing in a hydrogen atmosphere at 1,200° C. for 10 hours.

After microstrain was introduced by linearly (line width: 0.5 mm) irradiating a pulse laser at an interval of 11 mm in a direction perpendicular to the rolling direction, the steel sheet was pickled and immersed in a solution of $SbCl_3$ (0.01 mol/l, 90° C.).

After the formation of an insulation coating composed mainly of phosphate and colloidal silica, the steel sheet was subjected to recovery recrystallization annealing serving as a strain relief annealing at 800° C. for 5 hours. The magnetic properties and surface properties of the resulting product were as follows.

The magnetic properties were $B_{10}$:1.94 T and $W_{17/50}$:0.78 w/kg, and the surface properties were very good as the ratio of surface defect block produced was 1.1%.

EXAMPLE 10

A continuously cast slab containing C: 0.056%, Si: 3.41%, Mo: 0.025%, acid soluble Al: 0.030%, Se: 0.020%, Sn: 0.1%, Cu: 0.1% was heated at 1,430° C. for 4 hours and hot rolled to form a hot rolled steel sheet of 2.2 mm in thickness. Then, the steel sheet was subjected to a primary cold rolling at a reduction of about 40% and further to an intermediate annealing at 1,050° C. for 5 minutes. In the intermediate annealing, rapid heating treatment of 15° C./s was performed from 500° C. to 900° C., and rapid cooling treatment of 20° C./s was performed from 900° C. to 500° C. after the intermediate annealing.

Thereafter, the steel sheet was subjected to a secondary cold rolling at a reduction of about 85% to obtain a cold rolled steel sheet of 0.20 mm in gauge, during which a warm rolling at 250° C. was performed. Then, the steel sheet was subjected to decarburization and primary recrystallization annealing in a wet hydrogen atmosphere at 850° C., coated with an annealing separator mainly composed of MgO, slowly heated from 850° C. to 1,100° C. at 8° C./hr, and subjected to a purification annealing in a hydrogen atmosphere at 1,200° C. for 10 hours.

After a scriber was applied to the steel sheet surface at a width of 0.5 mm and an interval of 8 mm in a direction perpendicular to the rolling direction, an insulation coating composed mainly of phosphate and colloidal silica was baked, and recovery recrystallization annealing serving as a strain relief annealing was performed at 800° C. for 5 hours. The magnetic properties and surface properties of the resulting product were as follows.

The magnetic properties were $B_{10}$:1.94 T and $W_{17/50}$:0.76 w/kg, and the surface properties were very good as the ratio of surface defect block produced was 1.1%.

Industrial Applicability

As seen from the above explanations, the invention has a remarkable effect that grain oriented silicon steel thin sheets are created having such a low iron loss that the $B_{10}$ value is not less than 1.92 T and the $W_{17/50}$ value is not more than 0.85 W/kg (0.23 mm thickness) and very excellent surface properties can be produced industrially and stably. Particularly, products having excellent iron loss properties and surface properties can be produced in a stable manner by including Mo and Al into a steel material, subjecting a steel sheet to a two-stage cold rolling process to obtain a final cold rolled steel sheet, and forming heterogeneous microareas onto the steel sheet surface in decarburization and primary recrystallization annealing or after finish annealing to grow non-uniform and fine secondary recrystallized texture in Goss orientation.

We claim:

1. A method of producing from a steel slab a low iron loss grain oriented silicon steel thin sheet having recrystallized grains in a (110)<001> orientation and having excellent surface properties, which comprises incorporating into the steel slab molybdenum, silicon and aluminum as an inhibitor, wherein the amounts of molybdenum, silicon and aluminum are Si: 3.1~4.5 wt %, Mo: 0.003~0.1 wt %, acid soluble Al: 0.005~0.06 wt %, and at least one of S and Se is present in an amount of 0.005~0.1 wt % in total; subjecting said steel slab to hot rolling in the presence of said molybdenum and preventing oxidation of the grain boundary to form a hot rolled steel sheet; subjecting the hot rolled steel sheet to primary cold rolling at a reduction of 10~60% and an intermediate annealing and a secondary cold rolling at a reduction of 75~90% to obtain a cold rolled thin sheet having a final gauge of 0.1~0.25 mm; subjecting the cold rolled thin sheet to decarburization and primary recrystallization annealing in a wet hydrogen atmosphere; and subjecting the thin sheet to high-temperature finish annealing.

2. The method according to claim 1 wherein said intermediate annealing is performed under conditions that the heating rate during the temperature increasing stage from 500° C. to 900° C. is not less than 5° C. per second, and wherein the cooling rate during temperature decreasing stage from 900° C. to 500° C. is not less than 5° C. per second.

3. The method defined in claim 1 wherein the ratio of surface defect blocks, as defined herein, produced by the rolling steps is less than 6%.

4. A method of producing from a steel slab a low iron loss, high magnetic flux density grain oriented silicon steel thin sheet having recrystallized grains in a (110)<001> orientation and having excellent surface properties, which comprises incorporating into the steel slab molybdenum, silicon and aluminum as an inhibitor, wherein the amounts of molybdenum, silicon and aluminum are Si: 3.1~4.5 wt %, Mo: 0.003~0.1 wt %, acid soluble Al: 0.005~0.06 wt %, and at least one of S and Se is present in an amount of 0.005~0.1 wt % in total;

subjecting said steel slab to hot rolling in the presence of said molybdenum and preventing oxidation of the grain boundary to form a hot rolled steel sheet;

subjecting the hot rolled steel sheet to primary cold rolling at a reduction of 10~60% and an intermedicate annealing and a secondary cold rolling at a reduction of 75~90% to obtain a cold rolled thin sheet having a final gauge of 0.1~0.25 mm; subjecting the cold rolled thin sheet to decarburization and primary recrystallization annealing in a wet hydrogen atmosphere; before or after said decarburization and primary recrystallization annealing step subjecting the cold rolled thin sheet to a treatment for the formation of surface modified heterogeneous microareas onto the surface of the thin sheet; and subjecting the thin sheet to high-temperature finish annealing.

5. The method according to claim 4, wherein said intermediate annealing is performed under conditions that the heating rate during the temperature increasing stage from 500° C. to 900° C. is not less than 5° C. per second, and wherein the cooling rate during temperature decreasing stage from 900° C. to 500° C. is not less than 5° C. per second.

6. In a method of producing a low iron loss grain oriented silicon steel thin sheet having recrystallized grains in a (110)<001> orientation, wherein a steel slab is subjected to hot rolling to form a hot rolled steel sheet, the step which comprises incorporating into the steel slab molybdenum, silicon and aluminum, the content of silicon being in the range of 3.1~4.5 wt %, the amount of acid soluble aluminum being in the range of 0.005~0.06 wt %, said slab also containing at least one of sulfur and selenium in an amount of 0.005~0.1 wt %, the step which comprises incorporating into the steel slab molybdenum in an amount of 0.003~0.1 wt %, and conducting said hot rolling in the presence of said molybdenum thereby preventing oxidation of the grain boundary in the formation of the hot rolled steel sheet.

7. The method defined in claim 6 including the further step of incorporating into the steel slab Sb in an amount of 0.005–0.2 wt %.

8. The method defined in claim 6 including the additional step of treating for the formation of surface modified microareas onto the surface of said thin sheet. , said treating step being selected from the group consisting of a) forming a decarburization promotion area or a decarburization delay area on the steel sheet surface by applying a coating agent in a direction substantially perpendicular to the rolling direction, during said decarburization and primary recrystallization annealing;

b) introducing microstrains at local portions on the steel sheet surface by means of a laser, by discharge working, by a scriber, or by a ballpen microsphere; or c) forming uneven temperature areas on the steel sheet surface by nonuniform heat treatment.

9. The method defined in claim 6 comprising the additional steps of incorporating into the steel slab Sb in an amount of 0.005–0.2 wt %, and formation of surface modified microareas onto the surface of said thin sheet.

* * * * *

UNITED STATES PATENT AND TRADEMARK OFFICE

CERTIFICATE OF CORRECTION

PATENT NO. : 5,203,928

DATED : April 20, 1993

INVENTOR(S) : Yukio Inokuti et al

It is certified that error appears in the above-identified patent and that said Letters Patent is hereby corrected as shown below:

Column 17, line 49, please change "$KC^{l}$" to --KCl--;
line 56, please change "$Na_2S.9H_wO$" to --$Na_2S.9H_2O$--; and
line 57, please change "$S_2Cl2$" to --$S_2Cl_2$--.

Column 28, line 29, please change "dicate" to --diate--.

Signed and Sealed this

First Day of February, 1994

Bruce Lehman

*Attest:*

BRUCE LEHMAN

*Attesting Officer*

*Commissioner of Patents and Trademarks*